US006488187B2

(12) United States Patent
Sheffler et al.

(10) Patent No.: US 6,488,187 B2
(45) Date of Patent: Dec. 3, 2002

(54) SIFTER DISPENSING CAP AND BASE

(75) Inventors: Robert J. Sheffler, Morganville, NJ (US); Thomas J. Dolan, Flemington, NJ (US); Timothy Callahan, Bayville, NJ (US)

(73) Assignee: Brent River Packaging Corporation, Flemington, NJ (US)

( * ) Notice: Subject to any disclaimer, the term of this patent is extended or adjusted under 35 U.S.C. 154(b) by 0 days.

(21) Appl. No.: 09/741,253

(22) Filed: Dec. 21, 2000

(65) Prior Publication Data

US 2002/0079339 A1 Jun. 27, 2002

(51) Int. Cl.[7] ..... B67D 3/00

(52) U.S. Cl. ..... 222/480; 222/548; 222/553; 222/565; 222/142.1; 222/142.9; 220/254.1; 220/831; 220/832; 220/837

(58) Field of Search ..... 222/480, 548, 222/553, 565, 506, 142.1, 142.9; 220/837, 831, 268, 254, 832, 256, 253, 259

(56) References Cited

U.S. PATENT DOCUMENTS 3,101,877 A * 8/1963 Driscoll ..... 222/520
3,164,306 A * 1/1965 Kitterman et al. ..... 222/498
3,871,550 A * 3/1975 Chiappe ..... 220/339
3,912,128 A * 10/1975 Ziemann et al. ..... 222/541
3,952,914 A * 4/1976 Vogt ..... 220/339
4,076,152 A * 2/1978 Mumford ..... 222/545
4,489,864 A * 12/1984 Davis ..... 222/541
4,760,931 A * 8/1988 Gach ..... 215/235
4,936,494 A * 6/1990 Weidman ..... 222/480
4,949,865 A * 8/1990 Turner ..... 220/90.4
4,969,572 A * 11/1990 VanKerKhoven ..... 220/253
5,054,633 A * 10/1991 Reijenga ..... 215/220
5,139,181 A * 8/1992 VerWeyst ..... 222/480
5,167,338 A * 12/1992 Kick ..... 220/253
5,176,277 A * 1/1993 Schuermann ..... 220/253
5,195,645 A * 3/1993 Schuermann ..... 220/253
5,494,200 A * 2/1996 Sheffler et al. ..... 222/565
5,507,419 A * 4/1996 Martin et al. ..... 222/480
5,509,582 A * 4/1996 Robbins, III ..... 222/158
5,601,213 A * 2/1997 Daniello ..... 222/456
5,706,981 A * 1/1998 Nobakht ..... 222/132
5,799,838 A * 9/1998 Miller ..... 222/480
5,894,950 A * 4/1999 Kick ..... 220/268
5,897,036 A * 4/1999 DeCoster et al. ..... 222/480
5,915,601 A * 6/1999 Ullrich et al. ..... 222/541.6
5,971,231 A * 10/1999 Samz et al. ..... 222/480
6,193,116 B1 * 2/2001 Sheffler et al. ..... 222/480

* cited by examiner

*Primary Examiner*—Henry C. Yuen
*Assistant Examiner*—Frederick Nicolas
(74) *Attorney, Agent, or Firm*—John H. Crozier

(57) ABSTRACT

In a preferred embodiment, a sifter dispensing cap base for attachment to a package containing material to be dispensed, including: a vertical cylindrical shell portion; a web portion covering an upper end of the vertical cylindrical shell portion; the web portion including a flap, opening of the flap permitting access to the material; and the flap including a living hinge disposed along one edge thereof.

12 Claims, 6 Drawing Sheets

SIFTER DISPENSING CAP AND BASE

BACKGROUND OF THE INVENTION

1. Field of the Invention

The present invention relates to covers for containers generally and, more particularly, but not by way of limitation, to a novel sifter dispensing cap and base.

2. Background Art

Packages for the containment and dispensing of materials are widely used. Those under consideration here are principally used in the containment and dispensing of food products such as spices, grated cheese, artificial butter granules, candy sprinkles, dried herbs, cereal products, and synthetic flavors, but are not necessarily limited to consumables. A significant quantity of these packages comprise a twist cap design. The cap is generally a two-part construction with the upper, rotating section containing a horizontal web, divided into three, equal, circular sectors of 120 degrees each. One sector contains an opening that is essentially in the shape of a circular segment that permits the maximum rate of dispensing. Another sector contains round bores that may be of varying size and distribution. These openings are designed to sprinkle or distribute the contents more or less evenly over a designated surface. The third circular segment is free from any openings, serving to seal the package when it is in a non-dispensing mode.

A particular undesirable feature of the conventional construction of a sifter cap concerns the bottom half of rotating sifter caps in which the web thereof contains an area essentially coincident with the circular sector of the rotating cap that is open and permits the maximum rate of dispensing. This area is defined by very thin-walled borders with the intention of facilitating punching the area, or segment, through to separate it from the web, thus preparing the component for dispensing. This punching operation results in the segment being punched into the product contained in the package, subjecting each subsequent dispensing to partial plugging or actually shaking the segment into soup, gravy, stew, sauce, and the like.

It is also desirable that there be secure, positive, vertical anchoring of the rotating top and the fixed base to ensure relative rotation of those components with a minimum of surface friction and the dispensing rotation of the scalloped top may be accomplished with a smooth uninterrupted action.

It is further desirable that the orientation of the rotating top be precise with respect to the fixed base, so that the top circular segmental opening cooperates with the identical one in the base after the flap has been punched inwardly, the dispensing holes cooperate with the punched-in opening of the base, or the completely closed portion of the upper web shutting off the punched-in orifice of the bottom web. It is highly desirable that the upper component rotate smoothly, yet exhibit a marked resistance at each of the two dispensing or one non-dispensing orientations for proper function. It is equally desirable that the mechanisms that regulate the orientation be overridden with relative facility to advance the rotation to subsequent modes.

Accordingly, it is a principal object of the present invention to provide a sifter dispensing cap and base in which the material sealing the dispensing opening is not punched into the material held in the container.

A further object of the invention is to provide a sifter dispensing cap and base in which there is secure, positive, vertical anchoring of the rotating top and the fixed base to ensure relative rotation of those components with a minimum of surface friction.

Another object of the invention is to provide a sifter dispensing cap and base that facilitate orientation of the rotating cap on the fixed base in one of three positions, yet permits the orientating mechanism to be relatively easily overridden.

It is an additional object of the invention to provide such a sifter cap and base that can be economically constructed using conventional techniques.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a sifter dispensing cap base for attachment to a package containing material to be dispensed, comprising: a vertical cylindrical shell portion; a web portion covering an upper end of said vertical cylindrical shell portion; said web portion including a flap, opening of said flap permitting access to said material; and said flap including a living hinge disposed along one edge thereof.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1A:
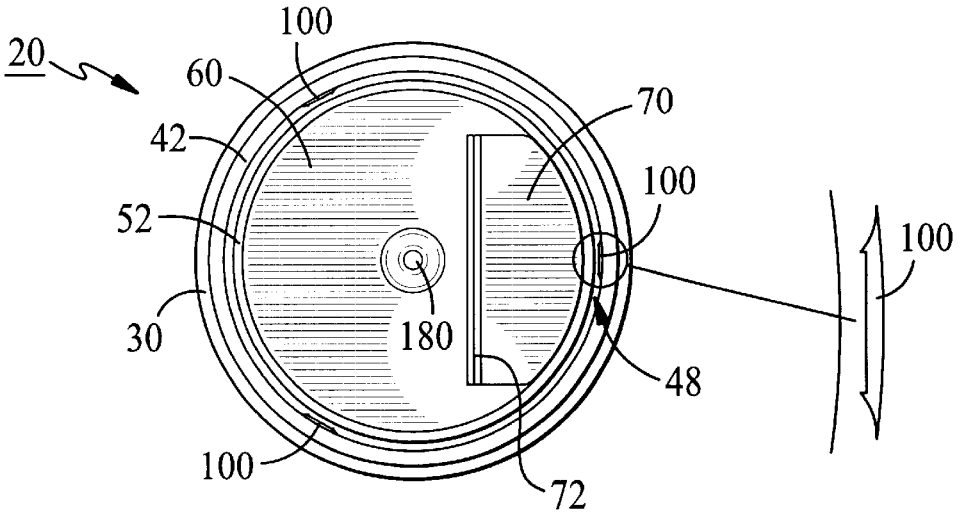
FIGS. 1(A), 1(B), and 1(C) are top plan, cross-sectional side elevational, and bottom plan views, respectively, of a fixed base according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 1B:
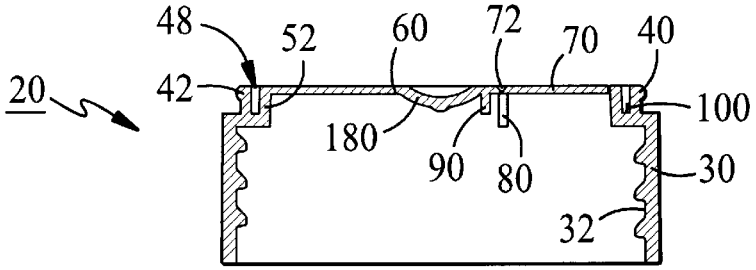
Figure 1C:
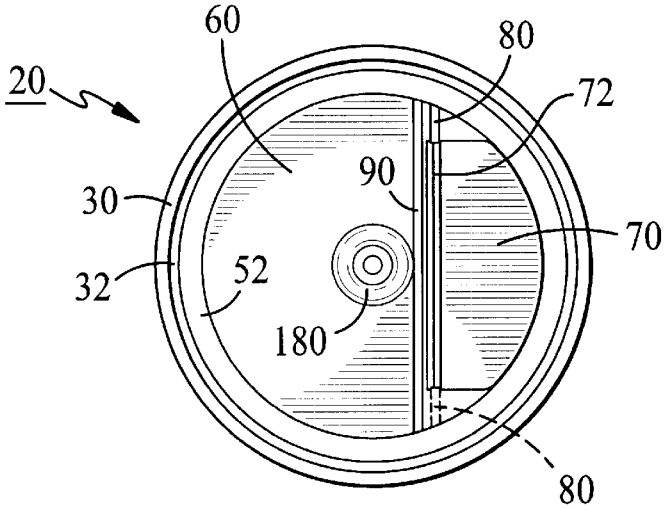

FIGS. 1(A), 1(B), and 1(C) are top plan, cross-sectional side elevational views, and bottom plan views, illustrating, respectively, a fixed base, constructed according to the present invention, and generally indicated by the reference numeral 20.

Referring first to FIG. 1(B), fixed base 20 includes a vertical, cylindrical shell portion 30 having a threaded internal surface 32 for attachment to an open top package (not shown) in the conventional manner. Fixed base 20 further includes a vertical circular outer ring 40 disposed around the top of the fixed base somewhat inboard of the outer surface of cylindrical shell portion 30 and having an outwardly facing circular locking element 42 disposed around the upper edge thereof. A tongue groove 48 is defined between the inner surface of vertical circular outer ring 40 and the outer surface of a vertical circular inner ring 52, the inner and outer rings having essentially equal heights. A horizontal web 60 extends between the upper edges of vertical circular inner ring 52 to form a cover for fixed base 20. A flap 70 (FIGS. 1(A) and 1(C)) has a straight living hinge 72 formed along one edge thereof and the balance of the attachment of the flap to horizontal web 60 is very thin-walled to facilitate the partial separation of the flap from the web. One or two door stops 80 (FIG. 1C) depending from the lower surface of web 60 extend partially inwardly from the inner surface of vertical circular inner ring 52 slightly inwardly of living hinge 72. One of door stops 80 is shown in broken lines to indicate that it is optional. Typically, two door stops 80 are provided on larger sifter dispensing caps 120 and only one is provided on smaller sifter dispensing caps. A governor bar 90 (FIG. 1B), parallel to door stops 80, and slightly inwardly thereof, depends from the lower surface of web 60 and extends between opposite sides of the inner surface of vertical circular inner ring 52.

Figure 6:
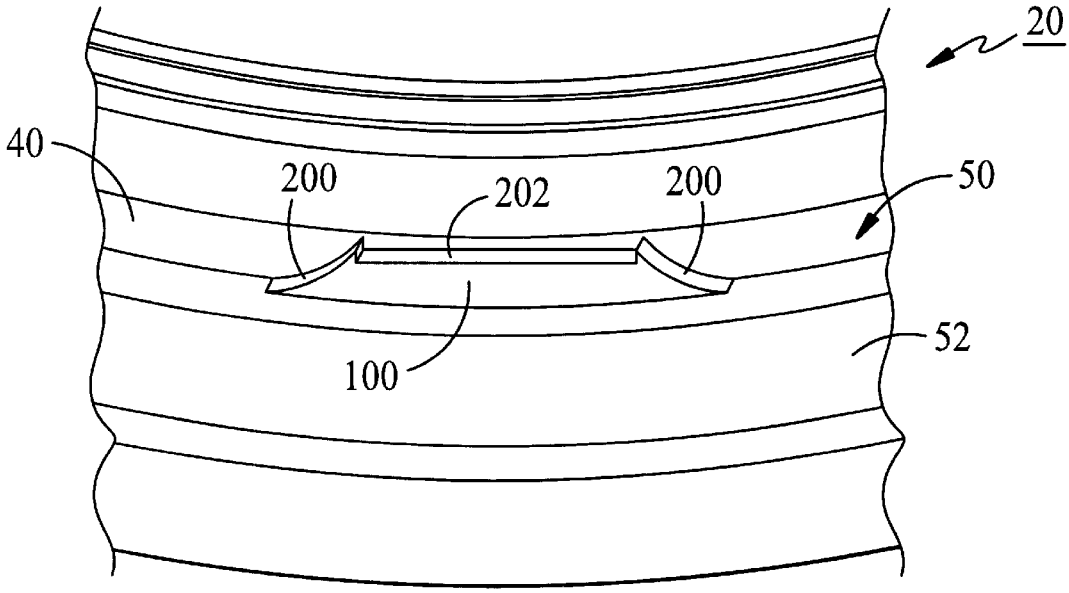
FIG. 6 is fragmentary isometric view showing the construction detail of a trap on the fixed base.

Referring to FIG. 1(A), three traps 100 are disposed in tongue groove 48 and spaced therealong at 120-degree intervals, the construction of which is detailed on FIG. 6.

Figure 2A:
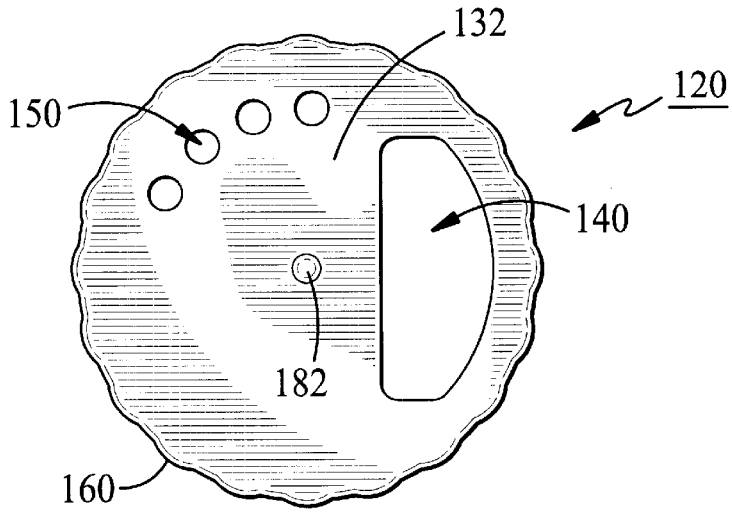
FIGS. 2(A), 2(B), and 2(C) are top plan, cross-sectional side elevational, and bottom plan views, respectively, of a rotatable cap according to the present invention.
Figure 2B:
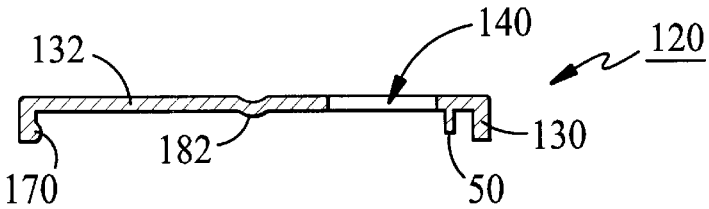
Figure 2C:
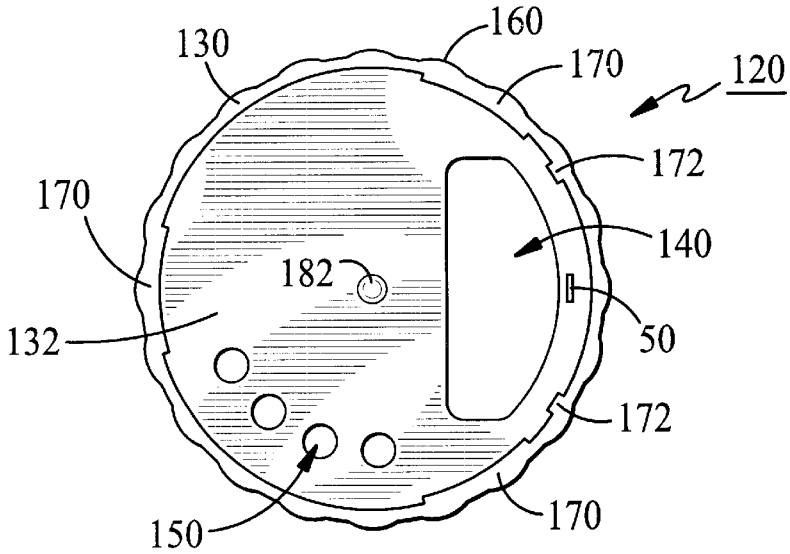

FIGS. 2(A), 2(B), and 2(C) are top plan, cross-sectional side elevational, and bottom plan views illustrating, respectively, a rotatable cap, constructed according to the present invention, and generally indicated by the reference numeral 120. Rotatable cap 120 includes a cylindrical vertical shell 130 and a cover 132 extending between edges of the cylindrical vertical shell (FIG. 2(B)). Defined through cover 132 is a relatively large opening 140 which is generally coextensive with flap 70 FIG. 1(A)). Also defined through cover 132 are a plurality of relatively small openings, as at 150, for the sifting of the contents of the package (not shown). A short tongue (FIGS. 2(B) and 2(C)) depends from the inner surface of cover 132 and rides in tongue groove 48 (FIG. 1(B). The outer surface 160 of cylindrical vertical shell 130 is scalloped FIGS. 2(A) and 2(C)) to facilitate the manual grasping of the outer surface to rotate rotatable cap 120. Three, equally spaced apart, inwardly facing arcuate locking elements 170 (FIG. 2C) are provided around the lower edge of cylindrical vertical shell 130. Nubs 172 (FIG. 2C) are disposed on either side of tongue 50. Nubs 172 face inwardly from the lower edge of cylindrical vertical shell 130 and, as will be understood from the following figures, especially FIG. 5, the nubs engage the underside of circular locking element 42 (FIG. 1(B) and overcome the tendency of cap 120 to lift slightly when in the most delivery dispensing mode.

Referring now to FIGS. 1(B) and 2(B), web 60 has a depressed central portion 180 which under some circumstances can fill with product from the package (not shown), such product being engaged by a nib 182 of rotatable cap 120 to space these components apart a slight distance, for facilitating operation of the rotatable cap.

Figure 3:
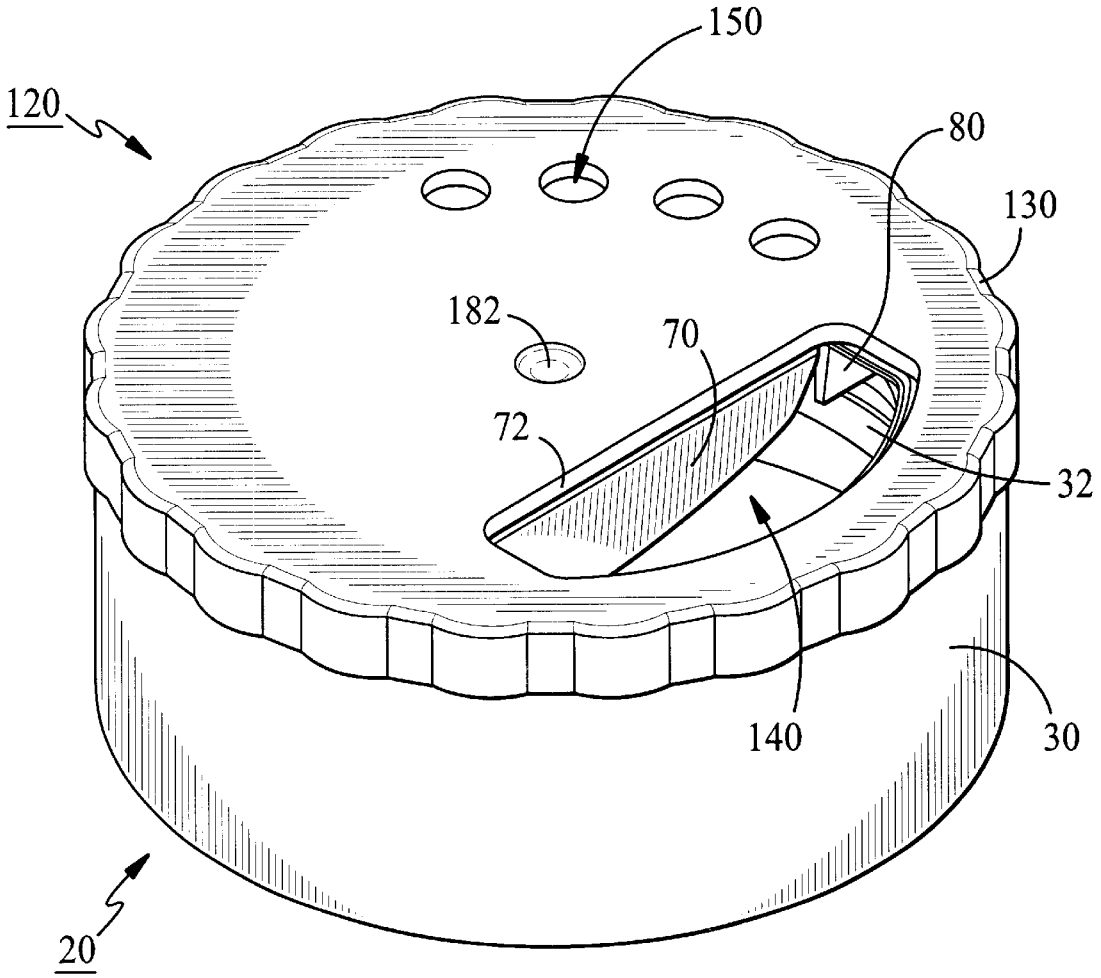
FIG. 3 is an isometric view of the rotatable cap mounted on the fixed base and with a punched-in flap.

FIG. 3 illustrates rotatable cap 120 disposed on fixed base 20, the attachment having been accomplished by circular locking elements 170 (FIG. 2(B)) bearing against circular locking element 42 (FIG. 1(B)), with the elastic plastic deformation of vertical circular outer ring 40. FIG. 3 also illustrates flap 70 having been severed from web 60, except for living hinge 72 and folded downwardly and inwardly to the position shown. Flap 70 has been elastically plastically deformed as it passed door stops 80 and now the door stops prevent flap 70 from passing thereby so as to protrude substantially into opening 140. In this position, flap 70 does not interfere with the operation of rotatable cap 120 and fixed base 20.

Figure 4:
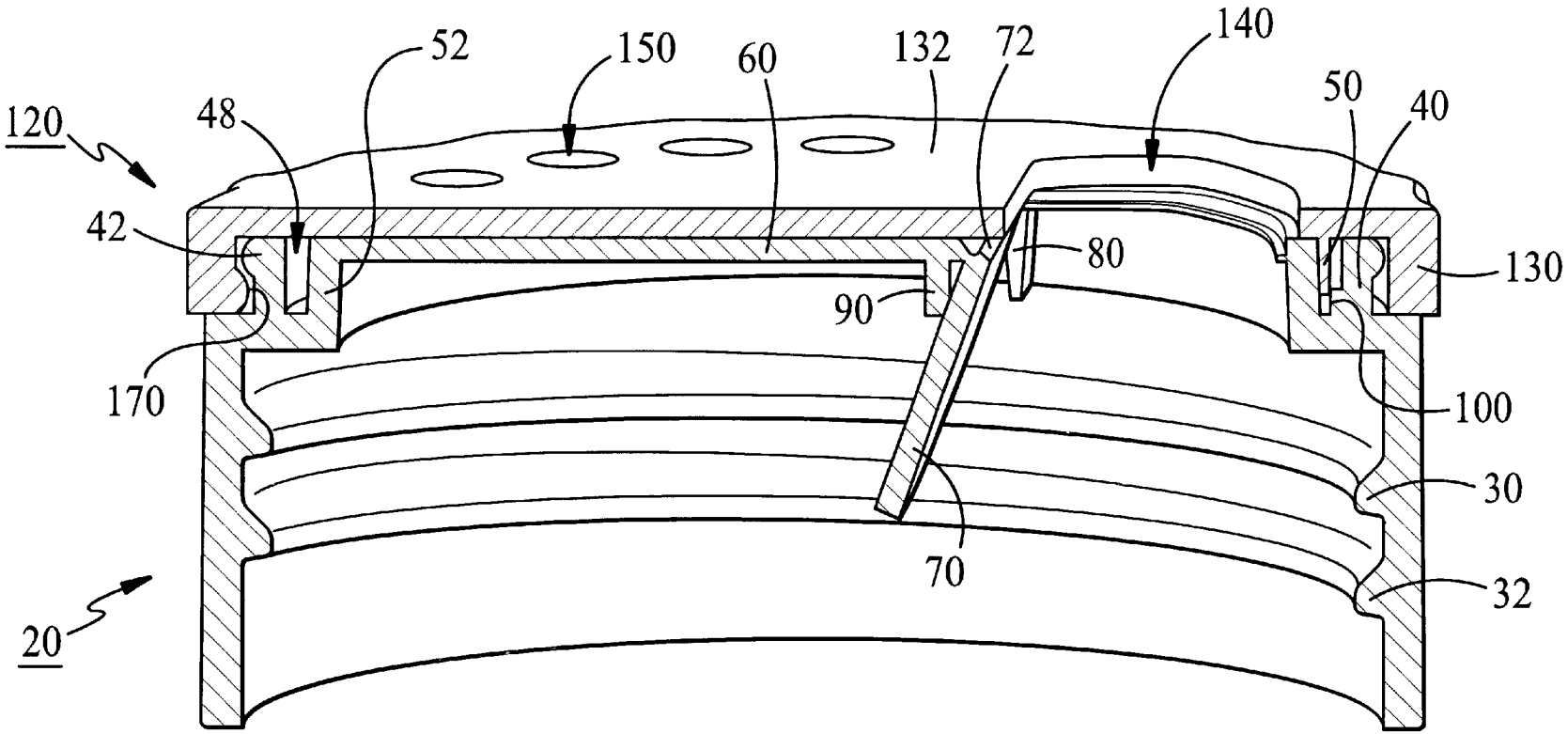
FIG. 4 is a cross-sectional side elevational view of the rotatable cap mounted on the fixed base and with a punched-in flap.

FIG. 4 illustrates the function of governor bar 90 which is to limit the degree to which flap 70 may be pressed inwardly by engaging the lower surface of the flap when it reaches the governor bar. This eliminates the possibility of overstressing hinge 72 to a degree that could result in fracture of the hinge. FIG. 4 also illustrates how circular locking elements 42 and 170 are generally vertically aligned and cooperate to slidingly secure rotatable cap 120 to fixed base 20. As indicated above, cap 120 and fixed base 20 have been assembled in the position shown by means of the temporary plastic deformation of those elements as the cap is snapped onto the fixed base. Also illustrated on FIG. 4 is tongue 50 engaging a trap 100.

Figure 5:
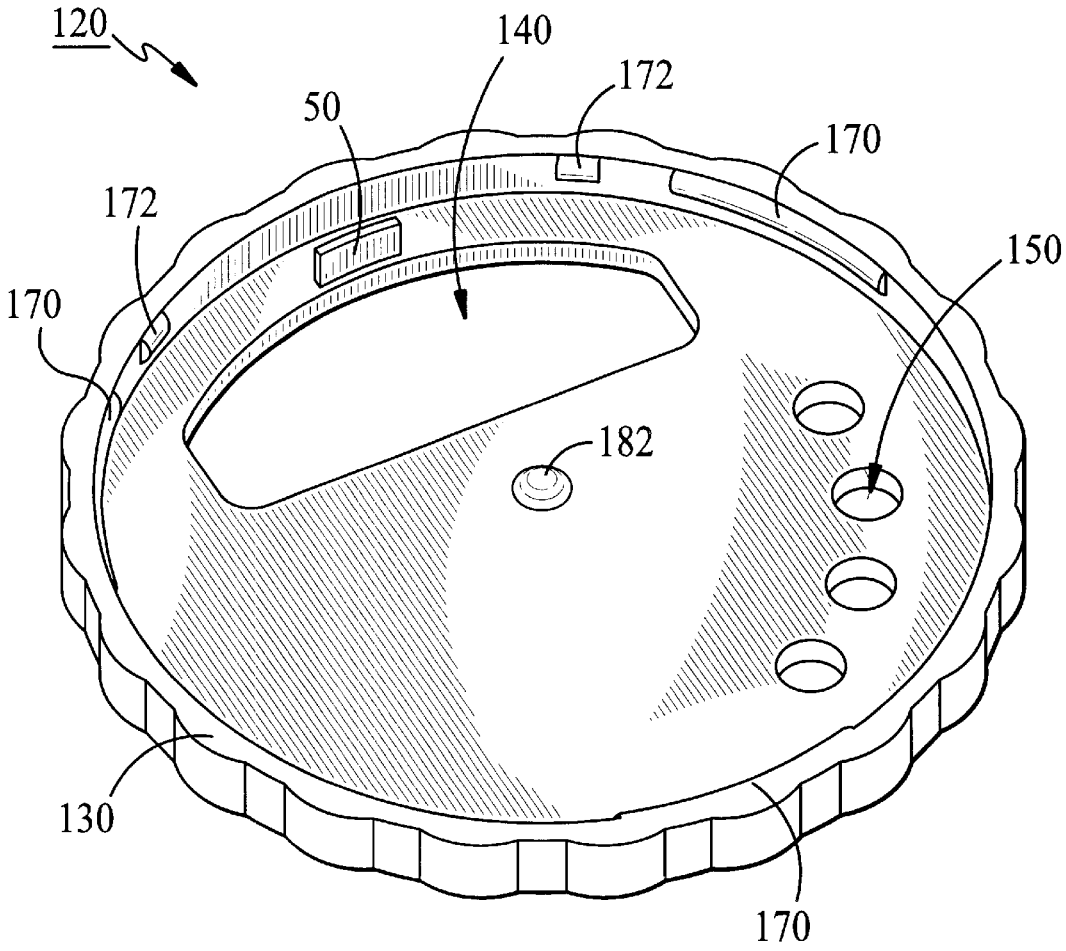
FIG. 5 is a an isometric view showing the bottom of the rotatable cap.

FIG. 5 illustrates more clearly arcuate locking elements 170 and nubs 172 and shows how those elements are disposed around the inner lower edge of cylindrical vertical shell 130.

FIG. 6 illustrates a trap disposed in tongue groove 48. As rotatable cap 120 is rotated on fixed based 20 (FIG. 4), tongue 50 rides up one of sloped ends 200, depending on the direction of rotation, and becomes lightly captured in lower central portion 202 of trap 100, thus lightly holding rotatable cap 120 in one of the three positions described above. However, if that is not the desired position, a moderate amount of force will disengage tongue 50 from lower central portion 202 and rotatable cap 120 can be rotated to a different position.

Figure 7:
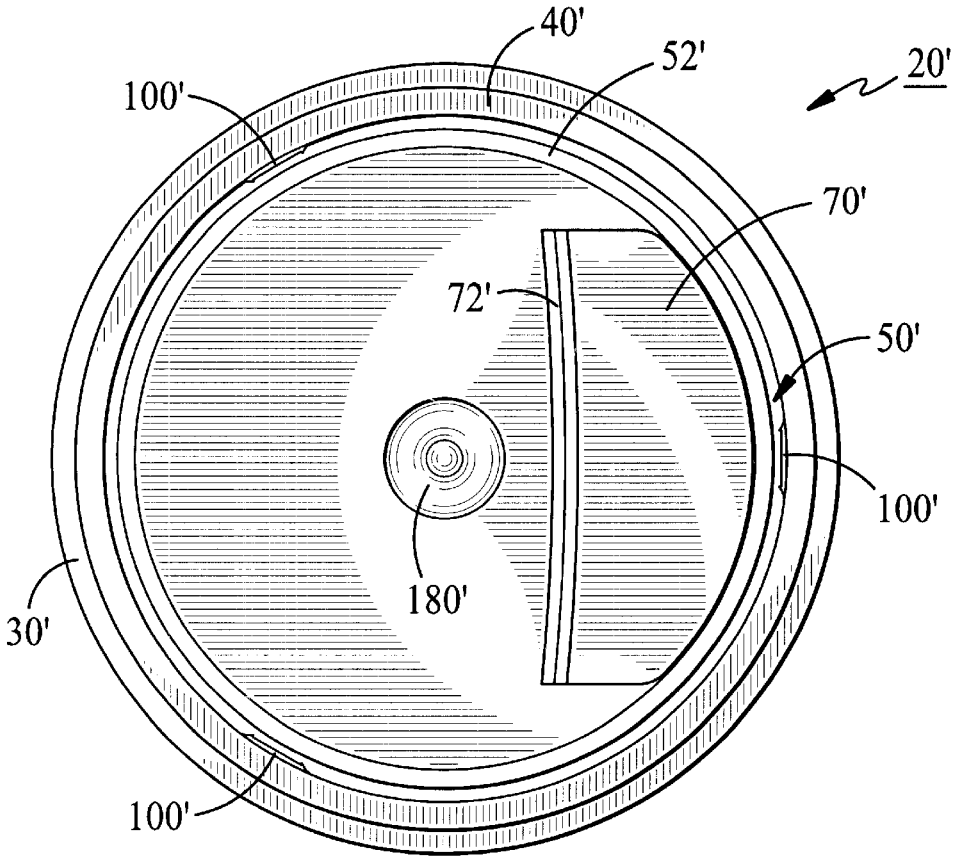
FIG. 7 is a top plan view of the fixed base showing an alternative embodiment of a flap.

FIG. 7 illustrates an alternative embodiment of a fixed base, here generally indicated by the reference numeral 20'. Elements of fixed base 20' similar or identical to elements of fixed base 20 (FIG. 1(A)) are given the same, but primed, reference numerals. Fixed base includes a flap 70' having an arcuate living hinge 72'. Thus arranged, flap 70' toggles as it is pressed downwardly and inwardly, thus holding the flap in place away from the opening created without the necessity of providing door stops 80 (FIG. 4). Governor bar 90 (FIG. 1B) is provided, however, to prevent overstressing hinge 72 to a degree that could result in fracture of the hinge.

Fixed base 20 and rotatable cap 120 can be economically constructed of suitable thermoplastic materials using conventional manufacturing techniques.

In the embodiments of the present invention described above, it will be recognized that individual elements and/or features thereof are not necessarily limited to a particular embodiment but, where applicable, are interchangeable and can be used in any selected embodiment even though such may not be specifically shown.

Spacially orienting terms such as "upper", "lower", "inner", "outer", "inwardly", "outwardly", "horizontal", "vertical", and the like, when used herein, refer to the positions of the respective elements shown on the accompanying drawing figures and the elements of the present invention are not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A sifter dispensing cap base for attachment to a package containing material to be dispensed, comprising:

(a) a vertical cylindrical shell portion;

(b) a web portion covering an upper end of said vertical cylindrical shell portion;

(c) said web portion including a flap, opening of said flap permitting access to said material; and (d) said flap including a living hinge disposed completely along one edge thereof from a first end of said edge to a second end -of said edge without any other structure being disposed in said one edge; and (e) a first stop mechanism disposed in said sifter dispensing cap base to prevent said flap from protruding substantially into an opening created by downward and inward pressing of said flap to create an opening in said web, without said first stop mechanism grasping a portion of said flap.

2. A sifter dispensing cap base, as defined in claim 1, further comprising: a second stop mechanism disposed in said sifter dispensing cap base to limit inward travel of said flap.

3. A sifter dispensing cap base, as defined in claim 1, wherein: said first stop mechanism comprises at least one door stop depending from an inner surface of said web and extending inwardly from an inner surface of a vertical circular ring disposed around an upper edge of said cylindrical shell portion.

4. A sifter dispensing cap base, as defined in claim 2, wherein: said second stop mechanism comprises a governor bar depending from an inner surface of said web and extending across a vertical circular ring disposed around an upper edge of said cylindrical shell portion.

5. A sifter dispensing cap assembly, comprising:

(a) a fixed base for attachment to a package containing material to be dispensed;

(b) said fixed base including a cylindrical shell portion, with inner and outer vertical cylindrical rings extending upwardly from an upper edge of said cylindrical shell portion and defining therebetween a circular groove;

(c) a rotatable cap disposed on said fixed base and selectively movable between a plurality of positions with respect to said fixed base;

(d) a tongue depending from an inner surface of said rotatable cap and inserted in said circular groove such that said tongue moves in said circular groove as said rotatable cap is rotated with respect to said fixed base; and (e) a plurality of traps disposed in said circular groove and engageable with said tongue, such that said rotatable cap can be lightly held in a selected one of said plurality of positions.

6. A sifter dispensing cap assembly, as defined in claim 5, wherein:

(a) each of said traps has first and second end portions sloping upwardly from a bottom of said circular groove to spaced apart first and second peaks; and (b) each of said traps has a lower central portion disposed between said first and second spaced apart peaks, said lower central portion being engageable by a lower end of said tongue to lightly hold said rotatable cap in a selected one of said plurality of positions.

7. A sifter dispensing cap, comprising:

(a) a fixed base for attachment to a package containing material to be dispensed;

(b) said fixed base including a vertical cylindrical shell portion and a vertical ring extending upwardly from an upper edge of said cylindrical shell portion, said vertical ring having an outwardly extending circular locking element disposed around an upper edge of an outer surface of said vertical ring;

(c) a rotatable cap disposed on said fixed base, said rotatable cap including a vertical cylindrical shell portion having a plurality of inwardly extending, spaced apart, arcuate locking elements disposed around a lower edge of an inner surface of said vertical cylindrical shell portion; and (d) said circular locking element and said plurality of arcuate locking elements being generally vertically disposed so as to rotatably secure said rotatable cap on said fixed base with a minimum of mutual surface engagement.

8. A sifter dispensing cap base for attachment to a package containing material to be dispensed, comprising:

(a) a vertical cylindrical shell portion;

(b) a web portion covering an upper end of said vertical cylindrical shell portion;

(c) said web portion including a flap, opening of said flap permitting access to said material;

(d) said flap including a living hinge disposed along one edge thereof;

(e) a first stop mechanism disposed in said sifter dispensing cap base to prevent said flap from protruding substantially into an opening created by downward and inward pressing of said flap to create an opening in said web; and (f) a second stop mechanism disposed in said sifter dispensing cap base to limit inward travel of said flap.

9. A sifter dispensing cap base, as defined in claim 8, wherein: said living hinge is arcuate and pressing said flap downwardly and inwardly causes said flap to toggle and said flap will remain in a downward and inward position by virtue of causing said flap to toggle.

10. A sifter dispensing cap base, as defined in claim 8, wherein: said first stop mechanism comprises at least one door stop depending from an inner surface of said web and extending inwardly from an inner surface of a vertical circular ring disposed around an upper edge of said cylindrical shell portion.

11. A sifter dispensing cap base, as defined in claim 8, wherein: said second stop mechanism comprises a governor bar depending from an inner surface of said web and extending across a vertical circular ring disposed around an upper edge of said cylindrical shell portion.

12. A sifter dispensing cap base for attachment to a package containing material to be dispensed, comprising:

(a) a vertical cylindrical shell portion;

(b) a web portion covering an upper end of said vertical cylindrical shell portion;

(c) said web portion including a flap, opening of said flap permitting access to said material;

(d) said flap including a living hinge disposed completely along one edge thereof from a first end of said edge to a second end of said edge without any other structure being disposed in said one edge; and wherein:

(e) said living hinge is arcuate and pressing said flap downwardly and inwardly causes said flap to toggle and said flap will remain in a downward and inward position by virtue of causing said flap to toggle, without the use of any stop mechanism.

* * * * *